US007841204B2

(12) United States Patent
Kim et al.

(10) Patent No.: US 7,841,204 B2
(45) Date of Patent: Nov. 30, 2010

(54) ICE DISPENSING APPARATUS AND REFRIGERATOR

(75) Inventors: Seong Jae Kim, Ansan-si (KR); Chang Ho Seo, Jinju-si (KR); Nam Gi Lee, Pohang-si (KR)

(73) Assignee: LG Electronics Inc., Seoul (KR)

( * ) Notice: Subject to any disclaimer, the term of this patent is extended or adjusted under 35 U.S.C. 154(b) by 416 days.

(21) Appl. No.: 11/965,172

(22) Filed: Dec. 27, 2007

(65) Prior Publication Data

US 2008/0156023 A1 Jul. 3, 2008

(30) Foreign Application Priority Data

Dec. 27, 2006 (KR) ..... 10-2006-0135132

(51) Int. Cl.
*F25C 5/18* (2006.01)

(52) U.S. Cl. ..... 62/344; 222/413

(58) Field of Classification Search ..... 62/344; 222/240–242, 413

See application file for complete search history.

(56) References Cited

U.S. PATENT DOCUMENTS 3,572,053 A * 3/1971 Jacobus et al. ..... 62/344
4,512,502 A * 4/1985 Landers ..... 222/413
5,037,004 A * 8/1991 Katz et al. ..... 222/146.6
5,117,654 A * 6/1992 Steffenhagen ..... 62/344
5,947,342 A * 9/1999 Song ..... 222/413
6,301,908 B1 * 10/2001 Huffman et al. ..... 62/137
7,017,363 B2 * 3/2006 Lee et al. ..... 62/320
7,631,513 B2 * 12/2009 Chung et al. ..... 62/320
2005/0044874 A1 * 3/2005 Lee et al. ..... 62/344
2010/0065715 A1 * 3/2010 Fan ..... 248/694

* cited by examiner

*Primary Examiner*—William E Tapolcai
(74) *Attorney, Agent, or Firm*—Fish & Richardson P.C.

(57) ABSTRACT

Provided is an ice dispensing apparatus. The ice dispenser discharges a predetermined number of ice pieces at a time, and thus malfunctioning or errors caused by bottleneck condition can be prevented. Furthermore, inside a case of the ice dispenser, pieces of ice can be effectively prevented from sticking to each other in a simple way, and thus the reliability of products can be increased. The ice dispensing apparatus includes a case, a driving unit, and a regulator. The case includes an inlet receiving ice and an outlet discharging ice. The driving unit is disposed inside or outside the case. The regulator is disposed in the case at a predetermined side and rotatable by the driving unit. The regulator includes a spiral blade having a predetermined blade interval. A predetermined number of pieces of ice are guided by rotation of the spiral blade to the outlet of the case.

15 Claims, 3 Drawing Sheets

ICE DISPENSING APPARATUS AND REFRIGERATOR

BACKGROUND

The present disclosure relates to an ice dispensing apparatus and a refrigerator, and more particularly, to an ice dispensing apparatus and a refrigerator from which a desired amount of ice can be conveniently dispensed.

Refrigerators are used to store food or other items for a long time at a low temperature by decreasing the temperature using a refrigeration cycle unit.

In addition to use as a low-temperature storage, some refrigerators can be used to make ice using air cooled to below the freezing point of water and dispense the ice in the form of cubes or crushed pieces.

For this, an icemaker and an ice dispenser can be installed in the refrigerator, particularly, at a position exposed to a stream of air cooled at a freezer chamber. The icemaker makes ice using air cooled at the freezer chamber, and the ice dispenser dispenses the ice in the form of cubes or crushed pieces.

Since the ice dispenser dispenses ice to the outside of the refrigerator by pushing stacked ice pieces or cubes, it is difficult to predict how many ice cubes or pieces will be discharged from the ice dispenser. For example, when the ice dispenser operates once, no ice cube can be discharged from the ice dispenser, or three or more ice cubes can be discharged from the ice dispenser. That is, since the number of ice cubes discharged from the ice dispenser is irregular, ice cubes discharged from the ice dispenser to a vessel can overflow. Furthermore, it can take much time to receive a desired number of ice cubes from the ice dispenser.

Moreover, if many ice cubes are discharged through the ice dispenser, an outlet of the ice dispenser can be blocked due to a bottleneck, followed by malfunctioning of the ice dispenser. In this case, a motor of the ice dispenser can be overloaded, and thus the ice dispenser can be broken.

In addition, since a shutter is installed on an outlet of a chute coupled to the outlet of the ice dispenser, a number of ice cubes can be unexpectedly discharged when the shutter is opened to receive ice from the ice dispenser.

SUMMARY

Embodiments provide an ice dispensing apparatus and a refrigerator that can discharge a desired number of ice pieces while preventing sticking of the ice pieces for prevention of malfunction and troubles and reliable use.

Embodiments also provide an ice dispensing apparatus and a refrigerator that can satisfy users by dispensing a constant number of ice pieces.

In one embodiment, an ice dispensing apparatus includes: a case including an inlet for receiving ice and an outlet for discharging ice; a driving unit inside or outside the case; and a regulator disposed in the case at a predetermined side and rotatable by the driving unit. The regulator includes a spiral blade having a predetermined blade interval, and a predetermined number of pieces of ice are guided by rotation of the spiral blade to the outlet of the case.

In another embodiment, a refrigerator includes: a main body including a storage chamber; a door configured to open and close the storage chamber; an icemaker disposed at one of the storage chamber and an inner side of the door for making ice; an ice dispensing apparatus; and a chute configured to receive ice from the ice dispensing apparatus and discharge the ice to an outside of the door. The ice dispensing apparatus includes: a case; a driving unit inside or outside the case; and a regulator including a cylinder part disposed in the case and a spiral blade fixed to an inner surface of the cylinder part. The regulator is rotatable by the driving unit.

In a further embodiment, an ice dispensing apparatus includes: a case; a driving unit inside or outside the case; and a regulator disposed in the case for discharging a predetermined number of pieces of ice at a time. The regulator includes: a cylinder part including an inlet at one side and an outlet at the other side and connected to an output side of the driving unit; a spiral blade fixed to an inner surface of the cylinder part; and a guide member configured to guide ice to the inlet of the cylinder part.

The details of one or more embodiments are set forth in the accompanying drawings and the description below. Other features will be apparent from the description and drawings, and from the claims.

According to the ice dispenser and the refrigerator of the present disclosure, a predetermined number of ice pieces can be dispensed at a time, and malfunctioning or errors caused by bottleneck condition can be prevented. Furthermore, inside the case of the ice dispenser, pieces of ice can be effectively prevented from sticking to each other in a simple way, thereby increasing the reliability of products.

DETAILED DESCRIPTION OF THE EMBODIMENTS

An ice dispensing apparatus and a refrigerator will now be described in detail with reference to the accompanying drawings, in which exemplary embodiments of the present disclosure are shown.

The ice dispensing apparatus of the present disclosure can be used in a refrigerator and other devices providing ice such as a vending machine and a water purifier. In the following description, the case where the ice dispensing apparatus is used in a refrigerator is exemplarily described.

Figure 1:
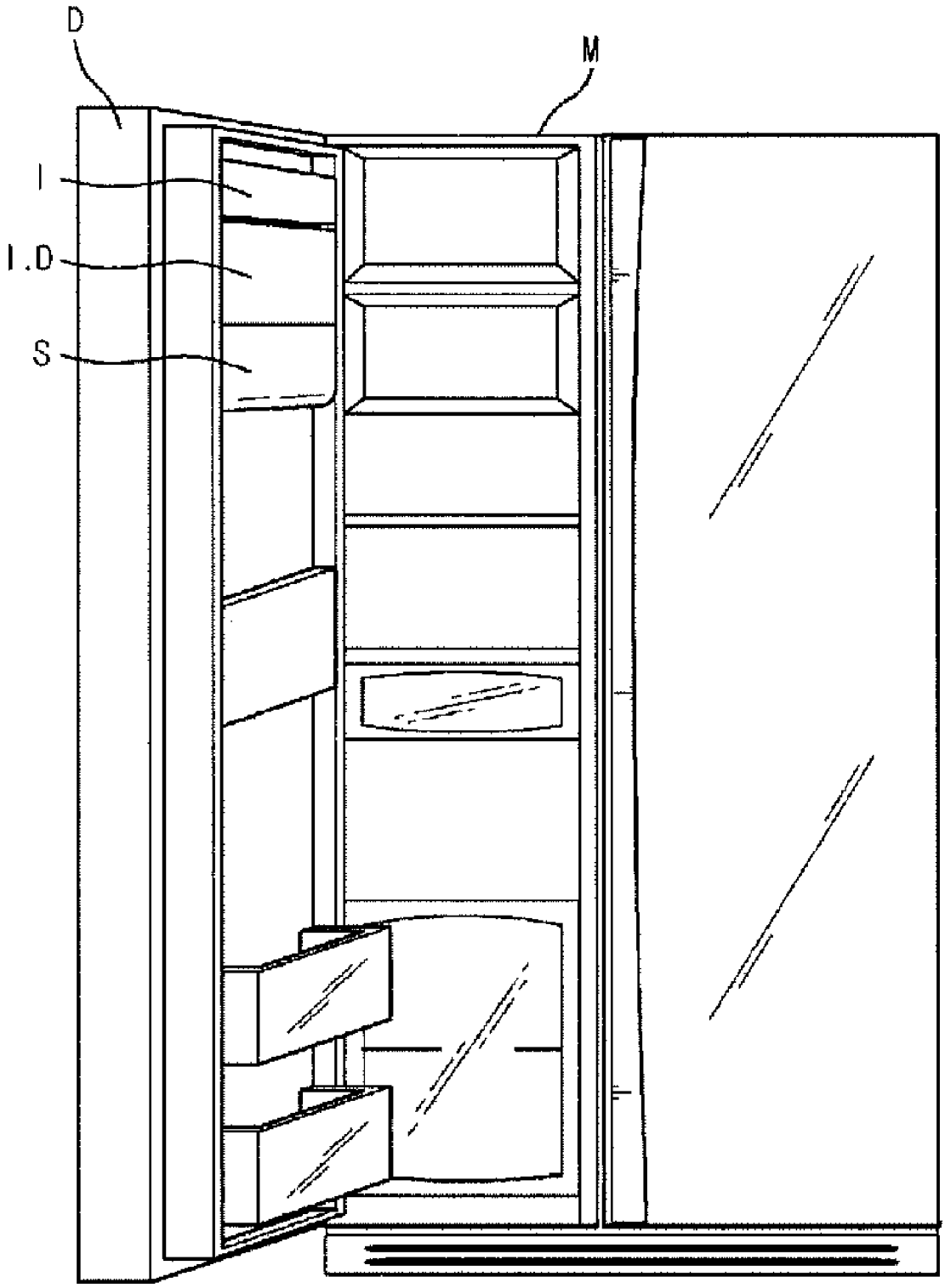
FIG. 1 is a perspective view illustrating a refrigerator according to an embodiment.

FIG. 1 is a perspective view illustrating a refrigerator according to an embodiment.

Referring to FIG. 1, the refrigerator of the current embodiment includes a main body (M), a freezer chamber (F) formed in the main body (M), and a door (D) closing and opening the freezer chamber (F). An icemaker (I), an ice dispenser I.D, and a chute (S) are installed inside the door (D). Alternatively, the icemaker (I), the ice dispenser I.D, and the chute (S) can be installed at the freezer chamber (F).

In both cases, the chute (S) is connected to the outside of the refrigerator so as to dispense ice to a user when the door is closed.

As explained above, the refrigerator includes the ice dispenser I.D. In the current embodiment, the ice dispenser I.D is installed at the door (D) of the refrigerator.

The ice dispenser I.D will now be described in more detail with reference to FIGS. 2 to 4 according to embodiments.

Figure 2:
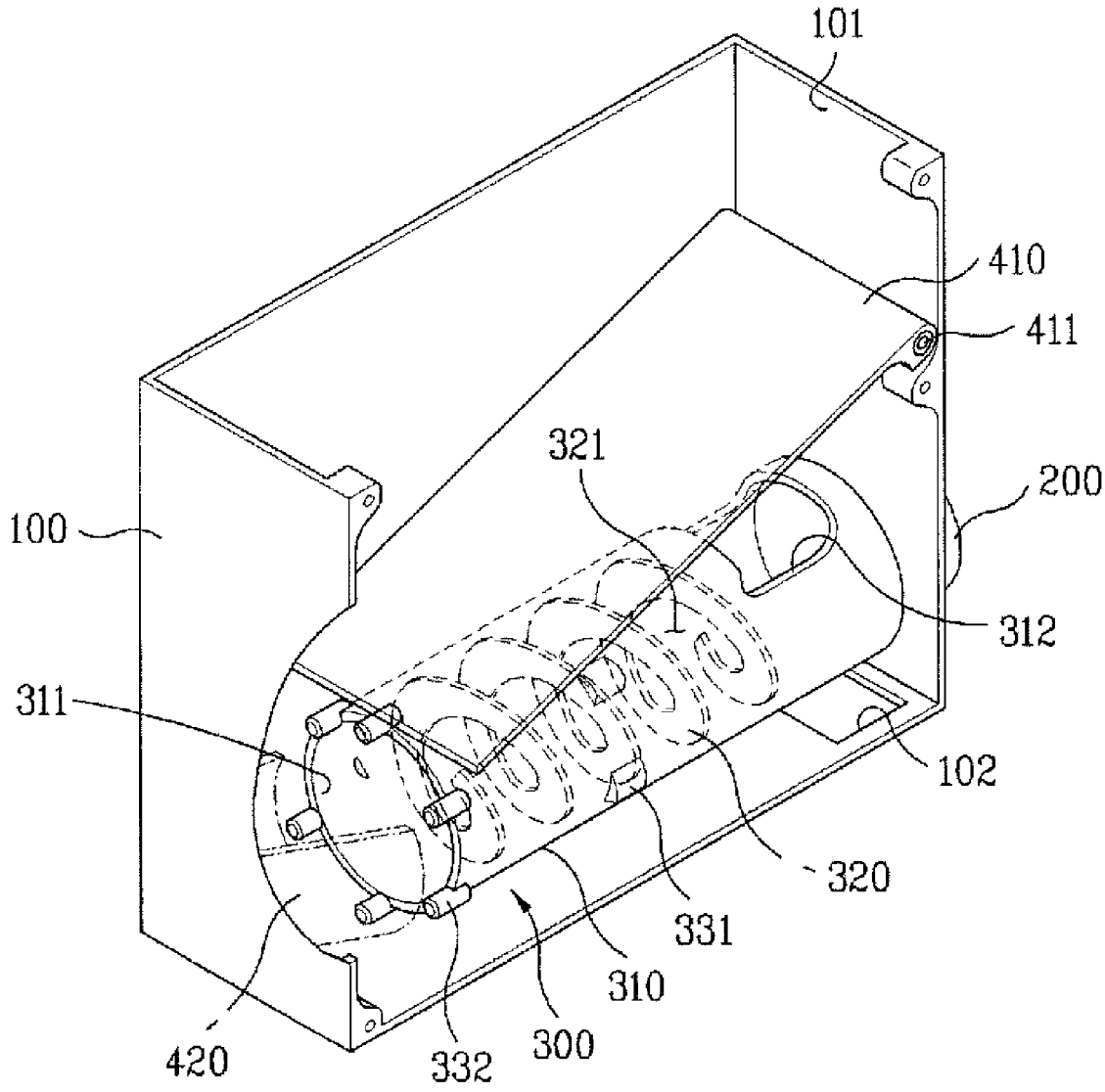
FIG. 2 is a cut-away view illustrating an ice dispenser according to an embodiment.

FIG. 2 is a cut-away view illustrating the ice dispensing I.D according to an embodiment.

Referring to FIG. 2, the ice dispenser I.D of the current embodiment includes a case 100, a driving unit 200, and a regulator 300. The case 100 forms a chamber for storing ice provided by the icemaker (I) (refer to FIG. 1). The case 100 includes an inlet 101 and an outlet 102. The driving unit 200 is installed inside or outside the case 100. The driving unit 200 can be a motor. The regulator 300 is disposed in the case 100 and is rotated by the driving unit 200 for moving pieces of ice uniformly to the outlet 102.

The regulator 300 includes a cylinder part 310, an inlet 311, and an outlet 312. The cylinder part 310 is a main body of the regulator 300, and the inlet 311 is formed on one end of the cylinder part 310 for receiving ice. The outlet 312 is formed on the other end of the cylinder part 310 for discharging ice from the cylinder part 310 to the outlet 102. The regulator 300 further includes a spiral blade 320 disposed in the cylinder part 310. The spiral blade 320 is placed in the length direction of the cylinder part 310 and has a predetermined blade interval. The spiral blade 320 can be formed integrally with the cylinder part 310 for rotating together with the cylinder part 310. Alternatively, the spiral blade 320 can be prepared as a separate part and then coupled to the cylinder part 310.

A penetration passage 321 is formed through the spiral blade 320. The penetration passage 321 is spaced a predetermined distance from the inner surface of the cylinder part 310. The predetermined distance is smaller than the inner radius of the cylinder part 310. The penetration passage 321 is connected to both ends of the cylinder part 310. That is, the penetration passage 321 is connected to the inlet 311 and the outlet 312. When the spiral blade 320 rotates, ice can be transferred from the inlet 311 to the outlet 312 through the penetration passage 321.

The penetration passage 321 may have an inner diameter corresponding to the size of a piece of ice to allow the ice piece to pass through the penetration passage 321. In other words, the penetration passage 321 is formed along a centerline of the spiral blade 320 or the cylinder part 310 to allow predetermined pieces of ice (for example, a piece of ice) to pass therethrough.

The driving unit 200 is coupled to the cylinder part 310 close to the outlet 312 to rotate the spiral blade 320. It is sufficient that the driving unit 200 can rotate the spiral blade 320 in one direction. That is, an inexpensive unidirectional motor can be used as the driving unit 200.

A first guide member 410 is disposed above the regulator 300 to guide ice from the inlet 101 to the inlet 311 of the regulator 300. In addition, as shown in FIG. 2, a second guide member 420 can be disposed at the inlet 311 of the regulator 300. In this case, ice can be easily guided in a desired direction.

In detail, the first guide member 410 is disposed above the regulator 300 and is sloped down from an inner surface of the case 100 adjacent to the inlet 101 towards the inlet 311 of the regulator 300. The second guide member 420 is sloped down from an inner surface of the case 100 opposite to the outlet 102 towards the inlet 311. The first guide member 410 includes a hinge portion 411 coupled to the inner surface of the case 100 adjacent to the outlet 102. Therefore, an end of the first guide member 410, which is opposite to the hinge portion 411 and adjacent to the inlet 311, can rotate about the hinge portion 411.

Figure 3:
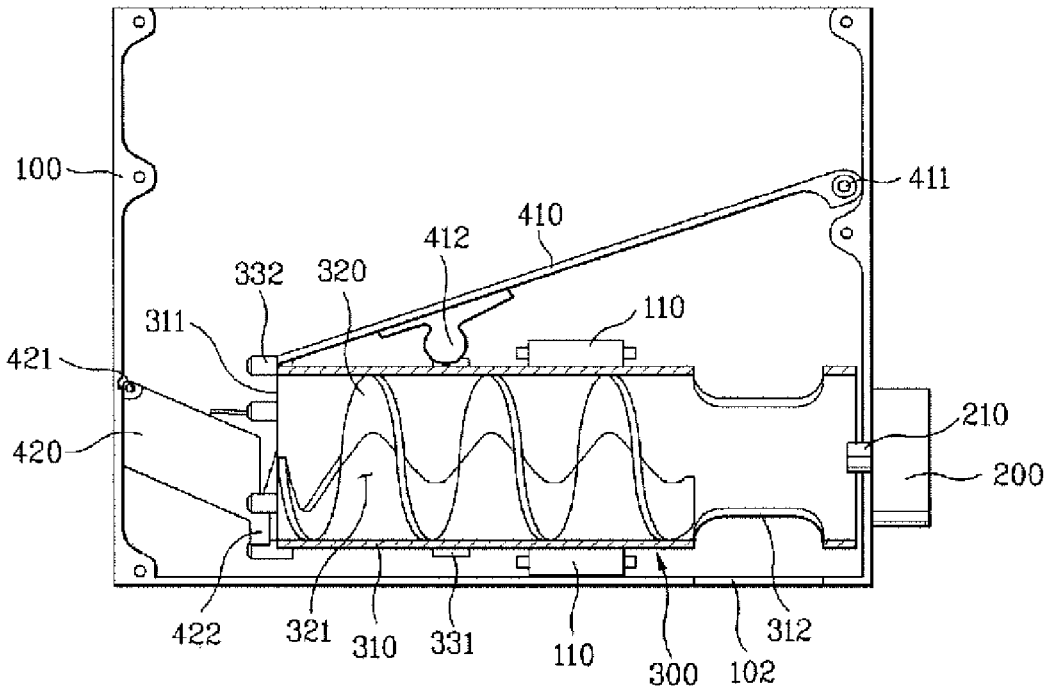
FIG. 3 is a side sectional view illustrating the ice dispenser of FIG. 2.

FIG. 3 is a side sectional view illustrating the ice dispenser I.D.

Referring to FIG. 3, the hinge portion 411 of the first guide member 410 is hinged on the inner surface of the case 100 adjacent to the outlet 102. The first guide member 410 further includes a first protrusion 412. The first protrusion 412 extends from a rear side of the first guide member 410 to a predetermined length.

At least one first tab 331 corresponding to the first protrusion 412 is formed on an outer surface of the cylinder part 310 of the regulator 300. Therefore, when the regulator 300 rotates, the first protrusion 412 of the regulator 300 collides with the first tab 331 of the first guide member 410 such that the first guide member 410 can swing on the hinge portion 411 within a predetermined angle. That is, substantially, the first guide member 410 can be vertically vibrated. Therefore, while the regulator 300 rotates, pieces of ice placed on the first guide member 410 can be prevented from sticking to each other.

The second guide member 420 is hinged on the inner surface of the case 100 opposite at a side opposite to the first guide member 410 and is sloped to the inlet 311 of the regulator 300. As shown in FIG. 2, the second guide member 420 is downwardly rounded to allow a predetermined number ice pieces to be inserted into the inlet 311.

A second protrusion 422 extends from a lower end of the second guide member 420 to a predetermined length, and at least one second tab 332 extends from the inlet 311 of the regulator 300 to a predetermined length. Therefore, when the regulator 300 rotates, the second tab 332 collides with the second protrusion 422 such that the second guide member 420 can swing on a hinge portion 421 of the second guide member 420 within a predetermined angle. That is, substantially, the second guide member 420 can be vertically vibrated in this way. Thus, pieces of ice placed on the second guide member 420 can be prevented from sticking to each other. The second protrusion 422 may be smoothly rounded to allow the second tab 332 to smoothly slide on the second protrusion 422 when the regulator 300 rotates.

Meanwhile, the regulator 300 is disposed in the case 100 with one end of the regulator 300 being supported by the driving unit 200. Thus, a support can be provided for supporting the other end of the regulator 300 while allowing rotation of the regulator 300. In the current embodiment, a rotation support member 110 is provided to support the regulator 300 while allowing rotation of the regulator 300.

For example, two rotation support members 110 can be disposed around the cylinder part 310 of the regulator 300 to allow smooth rotation of the regulator 300. Rollers can be used as the rotation support members 110.

Figure 4:
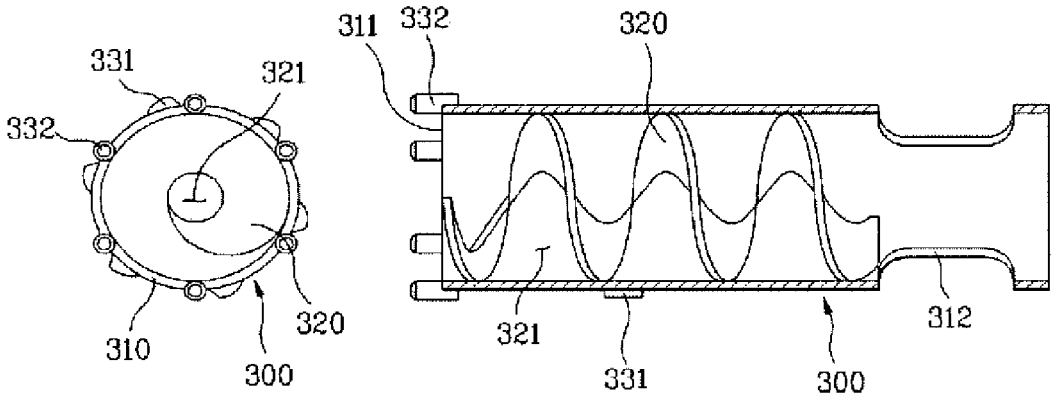
FIG. 4 is a view illustrating lateral and front sides of a regulator of the ice dispenser according to an embodiment.

FIG. 4 is a view illustrating lateral and front sides of the regulator 300 of the ice dispenser I.D according to an embodiment.

Referring to FIG. 4, the spiral blade 320 extends from the inlet 311 to the outlet 312 of the cylinder part 310, and the penetration passage 321 of the spiral blade 320 communicates with the inlet 311 and the outlet 312.

A plurality of first tabs 331 is formed along the outer surface of the cylinder part 310. One or both sides of each first tab 331 can be rounded. In the current embodiment shown in FIG. 4, one side of each first tab 331 is rounded. Therefore, when the regulator 300 rotates, the first tabs 331 can smoothly collide with the first protrusion 412 of the first guide member 410, and thus the first guide member 410 can be smoothly vibrated in a vertical direction. That is, since the first tabs 331 are rounded, the first guide member 410 can be prevented from being damaged by the rotation of the regulator 300, and the first tabs 331 can smoothly interact with the first protrusion 412.

This structure is also applied to the relationship between the second tab 332 of the regulator 300 and the second protrusion 422 of the second guide member 420. That is, at least one of the second tab 332 and the second protrusion 442 has a structure for reducing a collision impact. For example, one or both of the second tab 332 and the second protrusion can be smoothly rounded.

Exemplary functions and operations of the ice dispenser I.D and the refrigerator will now be described with reference to FIGS. 2 to 4.

Ice is introduced into the case 100 through the inlet 101, and the first guide member 410 guides the ice toward the inlet 311 of the regulator 300. At this time, the regulator 300 is rotated, and thus the first tabs 331 collide with the first protrusion 412 of the first guide member 410 at regular intervals. As a result, the first guide member 410 swings vertically within a predetermined angle. Owing to the vibration of the first guide member 410, pieces of the ice moving on the first guide member 410 can be prevented from sticking to each other.

Thereafter, the ice is guided by the second guide member 420 to the inlet 311 of the regulator 300. At this time, like the first guide member 410, the second guide member 420 swings vertically within a predetermined angle since the second tab 332 formed at the inlet 311 of the regulator 300 collides with the second protrusion 422 of the second guide member 420 at regular intervals. Therefore, pieces of the ice can smoothly move on the second guide member 420 and do not stick to each other.

Then, owing to the rotation of the regulator 300, a predetermined number of the ice pieces can be transported by the spiral blade 320 along the penetration passage 321. After that, the ice is discharged to the outlet 102 through the outlet 312.

One or two pieces of ice can be transported by the spiral blade 320 at a time according to the width and length of the spiral blade 320. That is, the number of ice pieces discharged to the outlet 102 can be adjusted by varying the width and length of the spiral blade 320.

In the embodiment shown in FIG. 1, the ice dispenser I.D is installed on the door (D) of the refrigerator to save the inside space of the refrigerator. For the same reason, the icemaker (I) is installed on the door (D).

In addition, the spiral blade 320 extends from the left to the right of the door (D) so that the ice dispenser I.D can be installed at a narrow place. Therefore, the ice dispenser I.D can be used more conveniently.

The present disclosure is not limited to the above-described embodiments. Other embodiments can be devised within the spirit and scope of the principles of this disclosure. Other embodiments of the present disclosure will now be described.

In the above-described embodiments, pieces of ice are discharged through the outlet 102. However, the present disclosure is not limited thereto. In other embodiments, an ice crusher can be installed near to the outlet 102, and the driving unit 200 can drive the ice crusher as well as the regulator 300. In this case, a bidirectional motor can be included in the driving unit 200 for driving both the ice crusher and the regulator 300. Alternatively, an additional motor can be used to drive the ice crusher.

In the case where a bidirectional motor is used for driving both the ice crusher and the regulator 300, the regulator 300 and a blade of the ice crusher can be rotated by properly disposing a driving gear of the bidirectional motor and a driven gear engaged with the driving gear.

In the above-described embodiments, two guide members 410 and 420 are included in the ice dispenser I.D. However, in other embodiments, one, three, or more guide members can be used. The number of guide members can be determined depending on application conditions, manufacturing costs, and efficiency.

In addition, although protrusions and tabs are used for vibrating the guide members 410 and 420 in the above-described embodiments, other structures such as a recess can also be used for the same purpose.

According to the ice dispenser and the refrigerator of the present disclosure, a predetermined number of ice pieces can be dispensed at a time, and malfunctioning or errors caused by bottleneck condition can be prevented. Furthermore, inside the case of the ice dispenser, pieces of ice can be effectively prevented from sticking to each other in a simple way, thereby increasing the reliability of products.

Moreover, in the case where the ice dispenser of the present disclosure is used in a refrigerator that is mainly used to store food at a low temperature and is not required to produce a large amount of ice continuously, the ice dispenser can provides efficient and inexpensive ice dispensing. In this case, the ice dispenser can be simply and conveniently installed at a door of the refrigerator.

What is claimed is:

1. An ice dispensing apparatus comprising:

a case including an inlet for receiving ice and an outlet for discharging ice;

a driving unit inside or outside the case; and a regulator disposed in the case at a predetermined side and rotatable by the driving unit, the regulator including a spiral blade having a predetermined blade interval, wherein a predetermined number of pieces of ice are guided by rotation of the spiral blade to the outlet of the case, wherein the regulator further includes:

a cylinder part enclosing the spiral blade, the cylinder part being formed integrally with the spiral blade or being coupled to the spiral blade;

an inlet disposed on one end of the cylinder part for introducing ice into the cylinder part; and an outlet disposed on the other end of the cylinder part for discharging ice from the cylinder part.

2. The ice dispensing apparatus according to claim 1, wherein the spiral blade extends from the inlet of the cylinder to the outlet of the cylinder part, and the spiral blade includes a penetration passage extending from one end to the other end of the cylinder part along a center line of the spiral blade, the penetration passage functioning as an ice transportation passage when the spiral blade rotates.

3. An ice dispensing apparatus comprising:

a case including an inlet for receiving ice and an outlet for discharging ice;

a driving unit inside or outside the case;

a regulator disposed in the case at a predetermined side and rotatable by the driving unit, the regulator including a spiral blade having a predetermined blade interval; and a guide member disposed in the case at a predetermined angle for guiding ice from the inlet of the case to the regulator, wherein a predetermined number of pieces of ice are guided by rotation of the spiral blade to the outlet of the case, and wherein the guide member is hinged on an inner surface of the case.

4. An ice dispensing apparatus comprising:

a case including an inlet for receiving ice and an outlet for discharging ice;

a driving unit inside or outside the case; and a regulator disposed in the case at a predetermined side and rotatable by the driving unit, the regulator including a spiral blade having a predetermined blade interval, a guide member disposed in the case at a predetermined angle for guiding ice from the inlet of the case to the regulator;

a tab on the regulator; and a protrusion on the guide member, wherein a predetermined number of pieces of ice are guided by rotation of the spiral blade to the outlet of the case, and wherein the protrusion collides with the tab when the regulator rotates such that the rotation of the regulator is converted into vibration of the guide member.

5. An ice dispensing apparatus comprising:

a case including an inlet for receiving ice and an outlet for discharging ice;

a driving unit inside or outside the case; and a regulator disposed in the case at a predetermined side and rotatable by the driving unit, the regulator including a spiral blade having a predetermined blade interval, wherein a predetermined number of pieces of ice are guided by rotation of the spiral blade to the outlet of the case, wherein the regulator is disposed in a lower region of the case in a left-to-right direction, and the ice dispensing apparatus further comprises:

a first guide member disposed at an inclined angle from an inner side of the case to an inlet of the regulator so as to guide ice from the inlet of the case toward the inlet of the regulator; and a second guide member disposed at an inclined angle from the other inner side of the case toward the inlet of the regulator so as to guide ice from the first guide member to the inlet of the regulator.

6. The ice dispensing apparatus according to claim 5, wherein the first and second guide members are hinged on the case.

7. The ice dispensing apparatus according to claim 5, further comprising:

at least one first tab protruding from an outer side of the regulator;

at least one second tab protruding from the other outer side of the regulator;

a first protrusion disposed on the first guide member to collide with the first tab of the regulator when the regulator rotates, so as to convert the rotation of the regulator into vibration of the first guide member, the vibration having a predetermined amplitude; and a second protrusion disposed on the second guide member to collide with the second tab of the regulator when the regulator rotates, so as to convert the rotation of the regulator into vibration of the second guide member, the vibration having a predetermined amplitude.

8. The ice dispensing apparatus according to claim 7, wherein the second guide member is rounded.

9. A refrigerator comprising:

a main body including a storage chamber;

a door configured to open and close the storage chamber;

an icemaker disposed at one of the storage chamber and an inner side of the door for making ice;

an ice dispensing apparatus; and a chute configured to receive ice from the ice dispensing apparatus and discharge the ice to an outside of the door, wherein the ice dispensing apparatus comprises:

a case;

a driving unit inside or outside the case; and a regulator including a cylinder part disposed in the case and a spiral blade fixed to an inner surface of the cylinder part, the regulator being rotatable by the driving unit.

10. The refrigerator according to claim 9, further comprising:

a first guide member disposed in an upper region of the case for guiding ice to an inlet of the cylinder part of the regulator; and a second guide member disposed in a lateral region of the case for guiding ice to the inlet of the cylinder part of the regulator.

11. The refrigerator according to claim 10, wherein at least one of the first and second guide members interferes with at least one portion of the cylinder part of the regulator such the at least one of the first and second guide members vibrates when the cylinder part rotates.

12. The refrigerator according to claim 9, wherein the ice dispensing apparatus further comprises a support configured to support rotation of the cylinder part.

13. The refrigerator according to claim 9, wherein the cylinder part and the spiral blade of the regulator rotate together.

14. The refrigerator according to claim 9, wherein the regulator is installed at the door.

15. An ice dispensing apparatus comprising:

a case;

a driving unit inside or outside the case; and a regulator disposed in the case for discharging a predetermined number of pieces of ice at a time, wherein the regulator comprises:

a cylinder part including an inlet at one side and an outlet at the other side, the cylinder part being connected to an output side of the driving unit;

a spiral blade fixed to an inner surface of the cylinder part; and a guide member configured to guide ice to the inlet of the cylinder part.

* * * * *